United States Patent [19]

Okada et al.

[11] Patent Number: 4,537,278

[45] Date of Patent: Aug. 27, 1985

[54] EXHAUST DUCT CONNECTOR

[75] Inventors: Makoto Okada, Tokyo; Kazunori Fujita, Tachikawa, both of Japan

[73] Assignee: Nissan Motor Company, Limited, Yokohama, Japan

[21] Appl. No.: 658,214

[22] Filed: Oct. 5, 1984

[30] Foreign Application Priority Data

Oct. 20, 1983 [JP] Japan ..... 58-197318

[51] Int. Cl.[3] ..... F01N 7/08

[52] U.S. Cl. ..... 181/227; 181/243; 181/264; 181/258

[58] Field of Search ..... 181/227, 243, 258, 264, 181/281

[56] References Cited

U.S. PATENT DOCUMENTS 1,468,241 9/1923 Larsen ..... 181/227 X 2,112,534 3/1938 Keen ..... 181/227 X

*Primary Examiner*—Benjamin R. Fuller

*Attorney, Agent, or Firm*—Schwartz, Jeffery, Schwaab, Mack, Blumenthal & Evans

[57] ABSTRACT

An exhaust duct connector takes the form of a Y-shaped passage. Both of the branches of the Y are adapted to receive ends of upstream exhaust ducts and a leg of the Y is adapted to receive one end of a downstream exhaust duct. A substantially plate-like partition is positioned at the junction of the Y parallel to the single leg. The partition includes a plurality of holes through which exhaust can pass. The partition may include an outer partition member having a plurality of holes and an inner partition having numerous extremely small holes covered by the outer partition member. The partition may contact the adjacent inside wall of the Y-shaped passage, or be spaced from the adjacent inside wall of the Y-shaped passage. The partition may take the form of an airfoil.

13 Claims, 24 Drawing Figures

EXHAUST DUCT CONNECTOR

BACKGROUND OF THE INVENTION

This invention relates to an exhaust duct for internal combustion engines and more particularly to a connector for exhaust ducts.

As shown in FIG. 1 of the accompanying drawings, a conventional exhaust duct assembly used in automotive vehicles includes a pair of upstream exhaust ducts 2, 3 connected at one end to an exhaust manifold 1, a Y-shaped connector 4 connecting the other ends of the exhaust ducts and an exhaust duct 5, two mufflers 6, 7, an exhaust duct 8 connecting two mufflers 6, 7 and a tail exhaust duct 9 (see Nissan service weekly No. 475 "Nissan skyline" published October, 1982 by Nissan Motor Company Ltd.).

As shown in more detail in FIG. 2, two upstream branches 4*a*, 4*b* of Y-shaped connector 4 snugly receive the ends of exhaust ducts 2, 3 and the downstream end of connector 4 receives one end of exhaust duct 5. In this exhaust duct arrangement, exhaust emissions from upstream ducts 2, 3 can mutually interfere constructively in connector 4, whereby the exhaust pressure waves can not enter downstream exhaust duct 5 easily. This causes part of the exhaust pressure waves to propagate upstream via exhaust ducts 2, 3, which interferes with other in-coming exhaust pressure waves, and causes exhaust impulse waves, thereby producing disturbingly loud noises. Furthermore, the upstream-propagating pressure waves lower exhaust efficiency and engine output.

SUMMARY OF THE INVENTION

It is therefore an object of this invention to provide a Y-shaped exhaust duct connector which suppresses upstream propagation of the exhaust pressure waves via the upstream exhaust ducts and suppresses generation of exhaust noise due to constructive interference of the exhaust pressure waves.

This invention provides a Y-shaped exhaust duct connector which includes a partition having a plurality of holes which allows the exhaust emission streams from the upstream exhaust ducts to merge smoothly while guiding the combined exhaust emission stream into the downstream exhaust duct.

The rate of exhaust flow from the upstream exhaust ducts through the individual holes is greatly decreased by the frictional resistance imparted by the holes. In addition, the exhaust pressure waves flowing downstream are subdivided through different passages through the partition so as to differ in phase, with the result that noises caused by constructive interference between exhaust pressure waves are reliably suppressed without raising the exhaust pressure.

The above and other objects, features and advantages of this invention will be apparent from the following description of preferred embodiments thereof, taken in conjuction with the accompanying drawings.

DETAILED DESCRIPTION OF THE PREFERRED EMBODIMENTS

Figure 1:
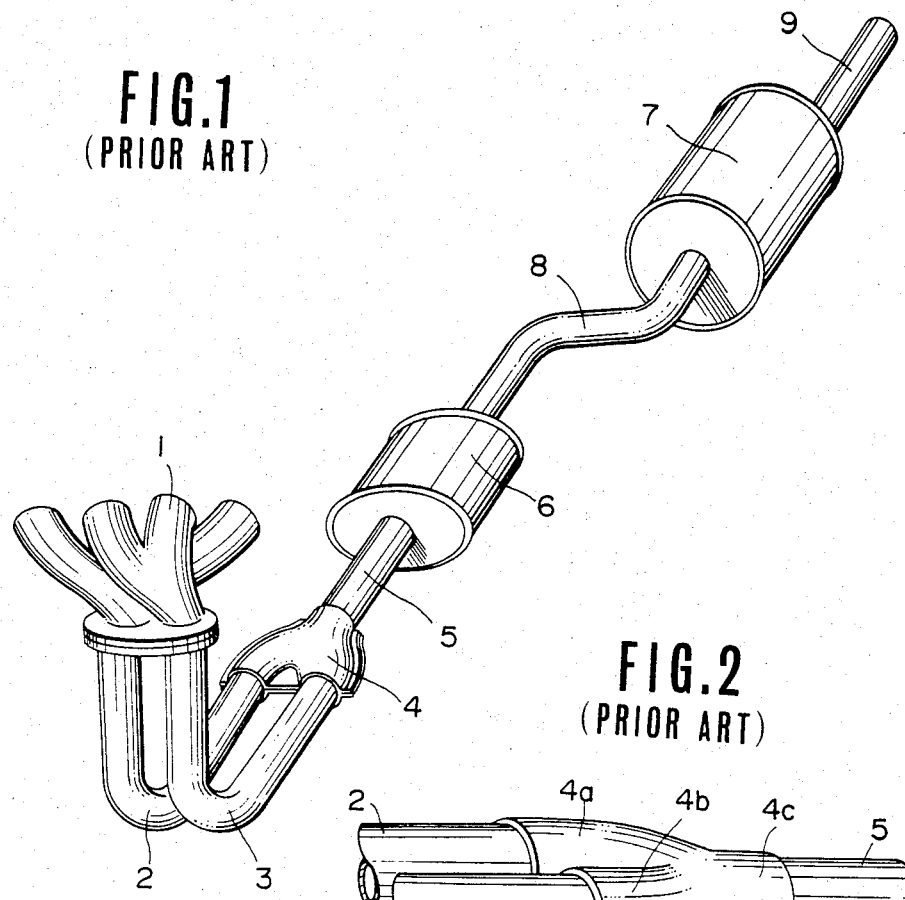
FIG.1 (PRIOR ART)
FIG. 1 is a perspective view of a prior art exhaust duct assembly.

Throughout the figures of the drawings, the same reference numerals are used to denote similar elements of the embodiments of this invention.

Figure 4A:
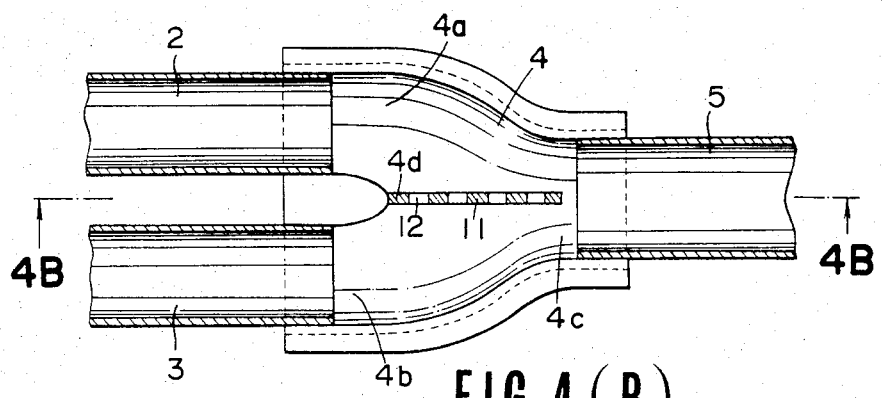
FIG. 4A is a view, similar to FIG. 3, of the corresponding part of a preferred embodiment of an exhaust duct assembly according to this invention.
Figure 4B:
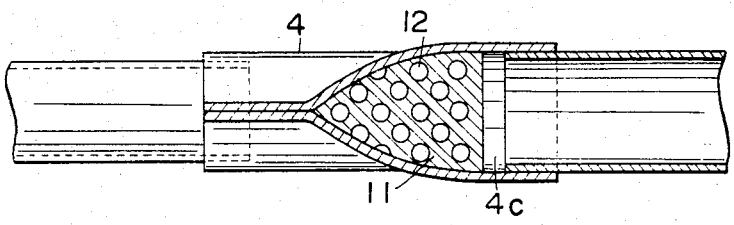
FIG. 4B is a cross-sectional view taken along the line 4B—4B of FIG. 4A.

Reference is made of FIGS. 4A and 4B which illustrate a first embodiment of an exhaust duct connector according to this invention. An exhaust duct connector 4 snugly receives the ends of a pair of upstream exhaust ducts 2 and 3, the other ends of which are connected to an exhaust manifold, not shown, of one or more engine cylinders, not shown. Connector 4 includes a partition 11 which serves to allow exhaust gases from exhaust ducts 2, 3 to smoothly merge. The partition extends from the central juncture or inside wall 4*d* of upstream branches 4*a* to 4*b* to a point upstream of the downstream end 4*c* of connector 4. The partition has a plurality of evenly distributed holes 12.

In operation, the exhaust pressure waves from the engine cylinders propagate via upstream exhaust ducts 2, 3 to connector 4. Only a small fraction of the exhaust pressure waves is reflected by connector 4 due to the frictional resistance imposed by partition 11 and propagates back up the opposite upstream exhaust duct 3 or 2 respectively but the major portions of the exhaust pressure waves merge smoothly at the downstream end of connector 4 due to the action of partition 11 and then propagate down the downstream exhaust duct 5. This serves to suppress propagation of the exhaust pressure waves back up the upstream exhaust ducts 2, 3.

Thus, interference between the exhaust pressure waves propagating upstream via exhaust ducts 2, 3 and the exhaust pressure waves from the subsequent engine exhaust stroke propagating downstream toward connector 4 is weakened and the exhaust noise resulting from such interference is greatly decreased.

In addition, partition 11 allows part of the exhaust pressure waves entering connector 4 from upstream ducts 2, 3 to pass through holes 12 distributed in partition 11 and then propagate via the throttle exit 4*c* of connector 4 to downstream duct 5. As the exhaust passes through holes 12, it is subjected to frictional resistance, so that the resulting flow rate of the exhaust is greatly decreased. Accordingly, the interference between the exhaust pressure waves propagating from exhaust duct 2 or 3 to connector 4 and the exhaust pressure waves propagating from connector 4 back up upstream ducts 3 or 2 is significantly weakened. The exhaust pressure waves passing through holes 12 in partition 11 and then out of connector 4 to downstream duct 5 are out of phase with the exhaust pressure waves propagating directly from the cylinders and upstream ducts 2, 3 to downstream duct 5. Thus, as the former and latter exhaust pressure waves merge in connector 4, the resultant amplitude of the combined pressure waves is moderated. Distributed holes 12 in partition produce broad phase distributions in the extensive frequencies of the exhaust pressure waves, so that the overall amplitudes of the exhaust pressure waves and hence that of the exhaust noise are greatly reduced by destructive interference. The holes 12 serve to smoothly mix the pulsating exhaust streams from exhaust ducts 2, 3, and the exhaust pressure gradient across the throttled exit end 4*c* of connector 4 is significantly reduced.

Figure 2:
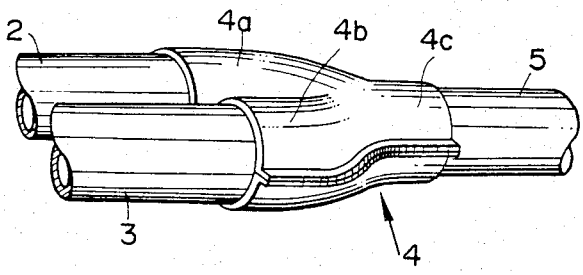
FIG.2 (PRIOR ART)
FIG. 2 is an enlarged perspective view of part of the assembly, including an exhaust duct connector.
Figure 3:
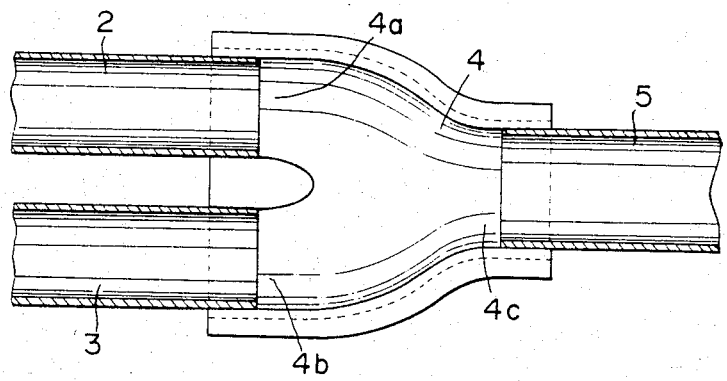
FIG.3 (PRIOR ART)
FIG. 3 is an enlarged cross-sectional view of the assembly of FIG. 2, taken along the longitudinal axes thereof.
Figure 5:
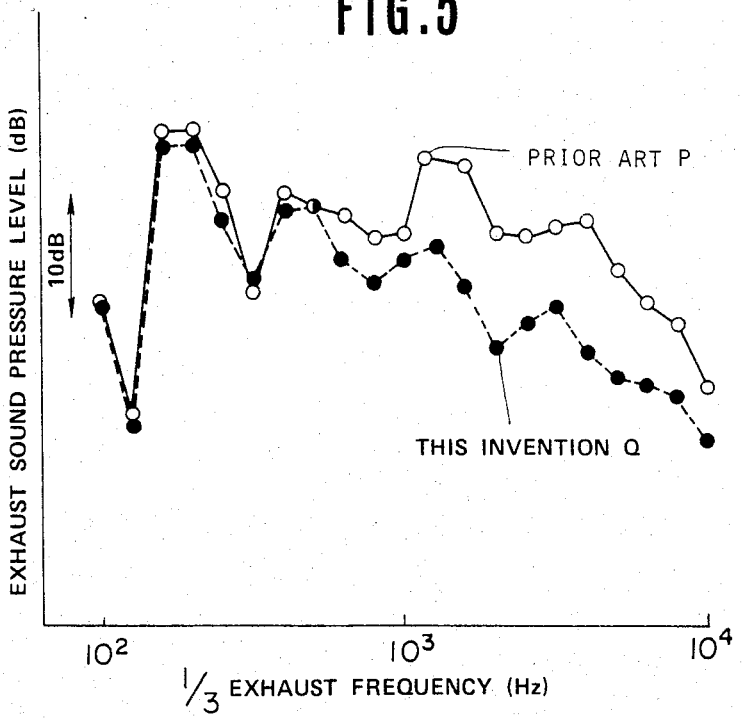
FIG. 5 is a graph of noise level vs. exhaust pressure wave frequency.

FIG. 5 is a characteristic graph of noise pressure illustrating the reduction of exhaust noise on the basis of experimental data. These data were obtained at a point 500 mm downstream of the exit of a tail duct such as is shown at 9 in FIG. 1 and at an angle of 45° to the axis of the tail duct at an engine speed of 2,700 rpm. It will be recognized that the noise produced by this embodiment was much lower as shown by the curve Q than that produced by the prior art exhaust assembly of FIGS. 1–3 especially at frequencies greater than 1 KHz as shown by curve P.

Figure 6A:
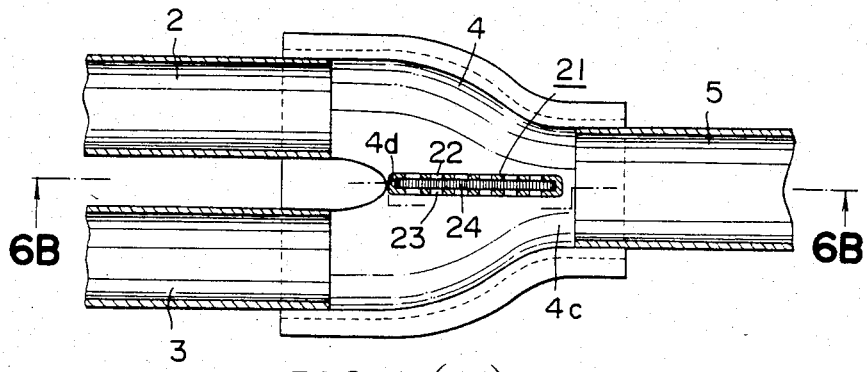
FIG. 6A is a view, similar to FIG. 4A, of a second embodiment of this invention.
Figure 6B:
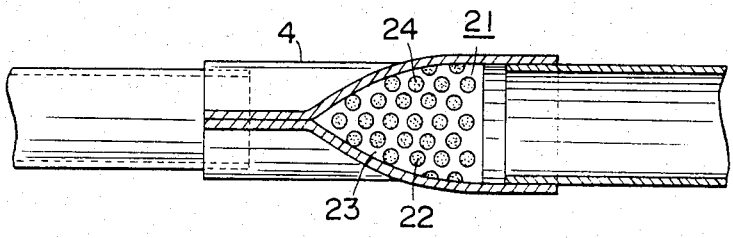
FIG. 6B is a view, similar to FIG. 4B, of the second embodiment, taken along the line 6B—6B of FIG. 6A.

FIGS. 6A and 6B illustrate a second embodiment of this invention in which the partition 21 includes an outer partition 22 having a plurality of holes 23 and an inner partition 24 covered by the outer partition. The inner partition 24 may be made of a porous heat-resistant material such as ceramics.

This porous partition 24 should have numerous extremely small holes which allow the exhaust to pass therethrough, but which do not allow acoustic waves to pass therethrough, i.e., which absorb the acoustic energy, and which rectify the pulsating exhaust flow. Consequently, cross-propagation between upstream exhaust ducts 2 and 3 is reduced, the pulsating exhaust noise is greatly reduced and high-frequency noises are absorbed by the exhaust duct assembly, thereby reducing exhaust noise to an even greater degree.

Figure 7A:
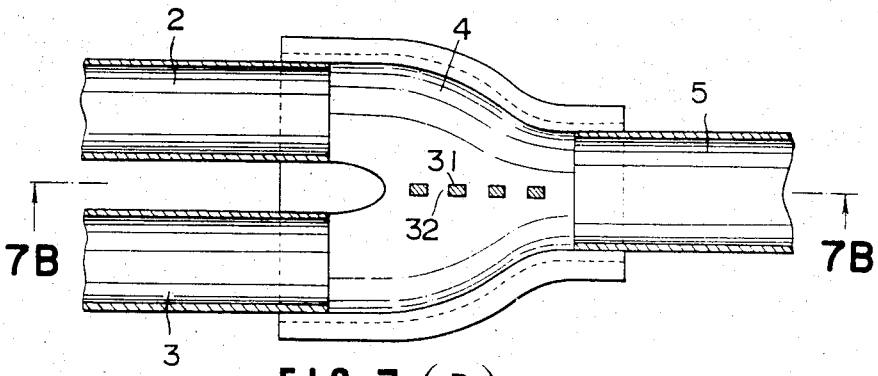
FIG. 7A is a view, similar to FIG. 4A, of a third embodiment of this invention.
Figure 7B:
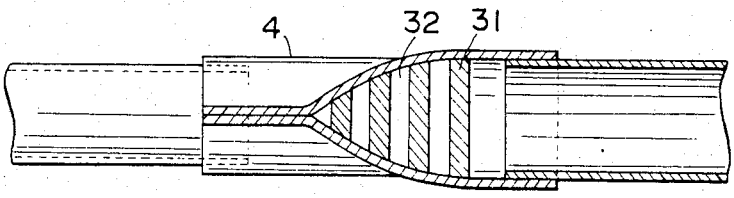
FIG. 7B is a view, similar to FIG. 4B, of the third embodiment, taken along line 6B—6B of FIG. 7A.

FIGS. 7A and 7B illustrate a third embodiment of this invention wherein the partition passages for exhaust gas are defined by a plurality of slits 32 in partition 31. Thus, part of the exhaust emissions flowing from upstream exhaust ducts 2, 3 to connector 4 pass through slits 32, so that the flow rate of this exhaust is decreased. This causes destructive interference between the two exhaust streams and hence reduces exhaust noise.

Figure 8A:
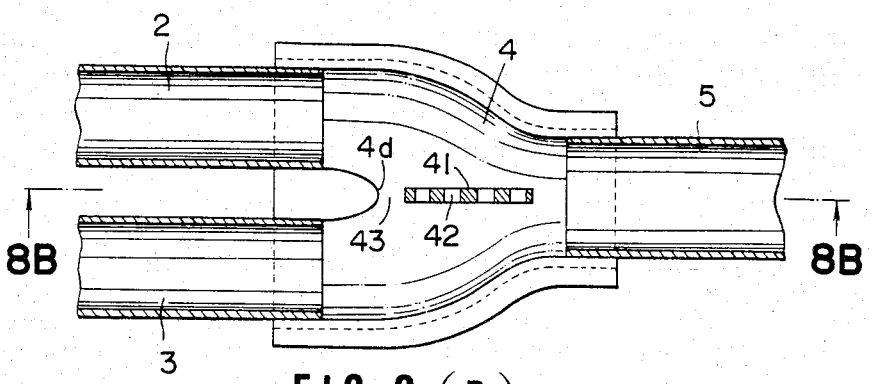
FIG. 8A is a view, similar to FIG. 4A, of a fourth embodiment of this invention.
Figure 8B:
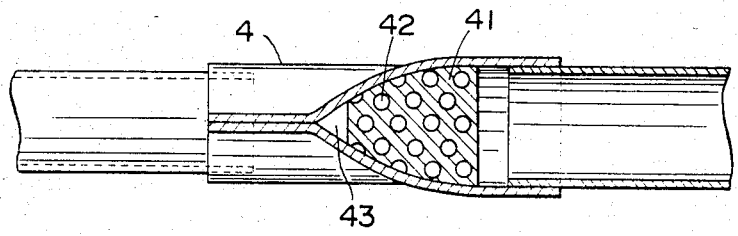
FIG. 8B is a view, similar to FIG. 4B, of the fourth embodiment, taken along line 8B—8B of FIG. 8A.

FIGS. 8A and 8B illustrate a fourth embodiment of this invention wherein a spacing 43 is provided between partition 41 and the juncture 4*d* of connector 4. Thus, the exhaust flowing from upstream exhaust ducts 2, 3 to connector 4 passes through small holes 42 in partition 41 and spacing 43 to exhaust duct 5. However, since the subdivided pressure waves passing through small holes 42 and through spacing 43 differ in amplitude and phase, destructive interference between the exhaust pressure waves decreases the overall exhaust noise.

Figure 9A:
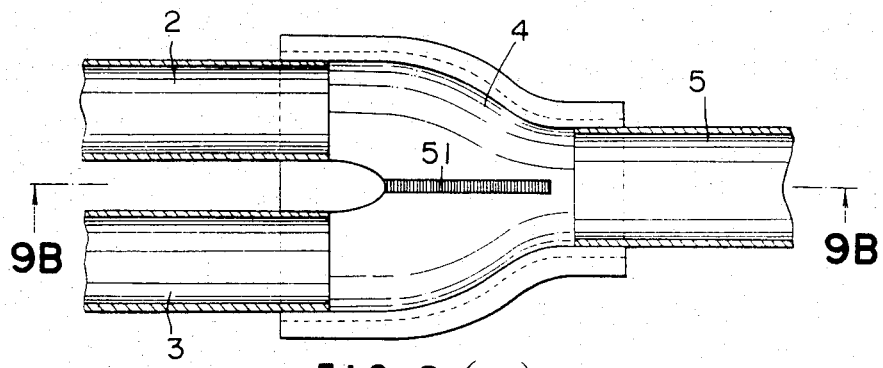
FIG. 9A is a view, similar to FIG. 4A, of a fifth embodiment of this invention.
Figure 9B:
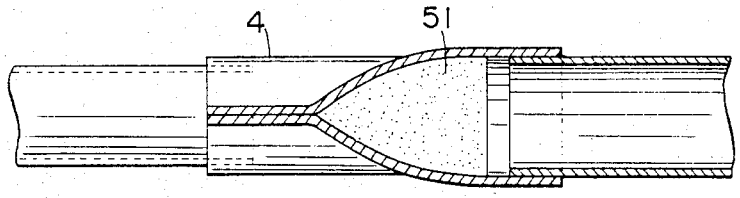
FIG. 9B is a view, similar to FIG. 4B, of the fifth embodiment, taken along line 9B—9B of FIG. 9A.

FIGS. 9A and 9B illustrate a fifth embodiment of this invention wherein partition 51 is made of the same porous material as the inner partition 24 of FIGS. 6A and 6B. Accordingly, partition 51 has the same effect as the inner partition 24.

Figure 10:
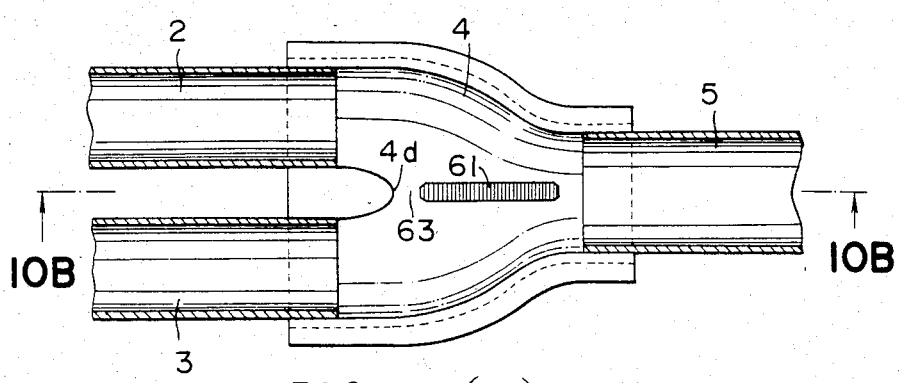
FIG. 10A is a view, similar to FIG. 4A, of a sixth embodiment of this invention.
FIG. 10B is a view, similar to FIG. 4B, of the sixth embodiment, taken along line 10B—10B of FIG. 10A.
Figure 10:
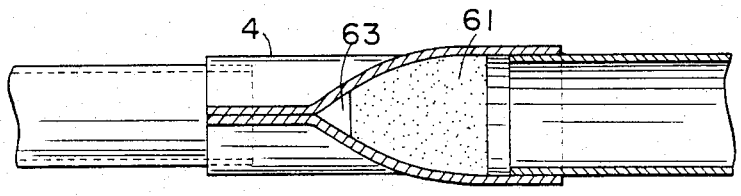

FIGS. 10A and 10B illustrate a sixth embodiment of this invention wherein a spacing 63 is provided between partition 61 of the same material as partition 51 of FIGS. 9A and 9B and the juncture 4*d* of connector 4. Thus, the combination of the effects of porous partition 61 and spacing 63 reduces the amplitude of exhaust pressure waves exitting the connector 4.

Figure 11:
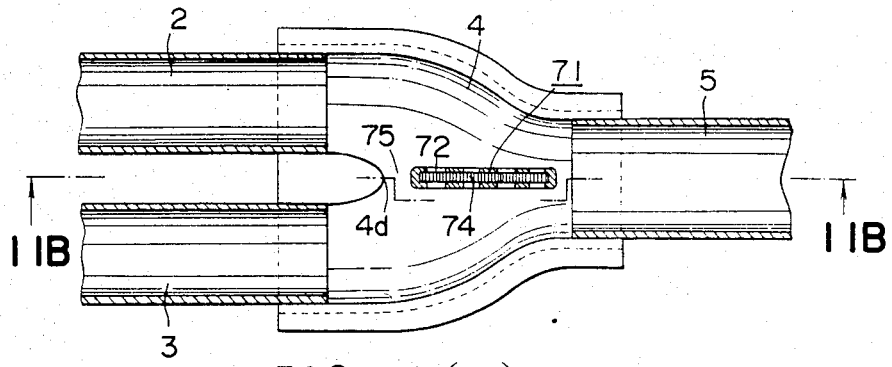
FIG. 11A is a view, similar to FIG. 4A, of a seventh embodiment of this invention.
FIG. 11B is a view, similar to FIG. 4B, of the seventh embodiment, taken along line 11B—11B of FIG. 11A.
Figure 11:
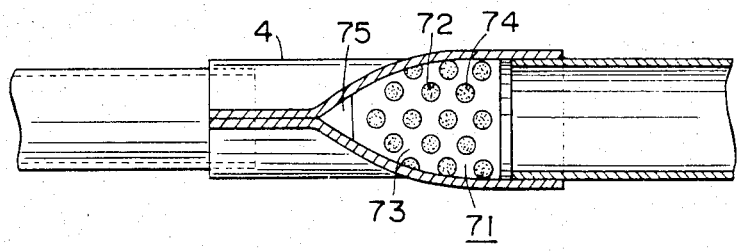

FIGS. 11A and 11B illustrate a seventh embodiment of this invention wherein a spacing 75 is provided between the juncture 4*d* of connector 4 and partition 71, and wherein the partition 71 includes an inner partition 74 of the same porous material as the inner partition 24 of FIGS. 6A and 6B and an outer partition enclosing the inner partition 74 and having a plurality of small holes 72. This assembly serves to suppress exhaust noise by the combination of the effect brought about by the second embodiment and the provision of the spacing.

Figure 12:
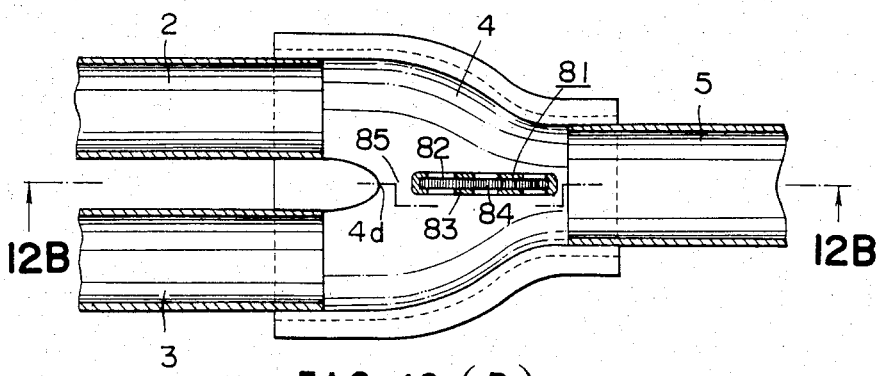
FIG. 12A is a view, similar to FIG. 4A, of an eighth embodiment of this invention.
FIG. 12B is a view, similar to FIG. 4B, of the eighth embodiment, taken along line 12B—12B of FIG. 12A.
Figure 12:
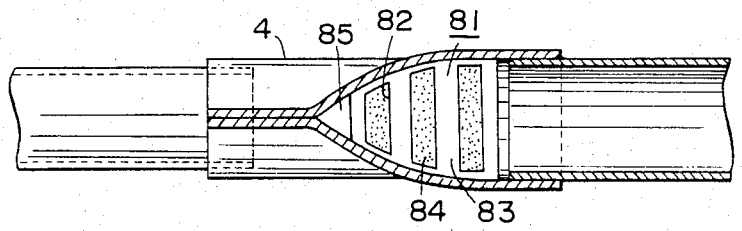

FIGS. 12A and 12B illustrate an eighth embodiment of this invention wherein a spacing 85 is provided between the juncture 4*d* of connector 4 and a partition assembly 81 and wherein the partition 81 includes an inner partition 84 of the same material as the inner partition 24 of FIGS. 6A and 6B and an outer partition 83 having a plurality of slits 82. Thus, this exhaust assembly has the combination of the advantages of the assemblies of FIGS. 11A and 11B and FIGS. 7A and 7B.

Figure 13:
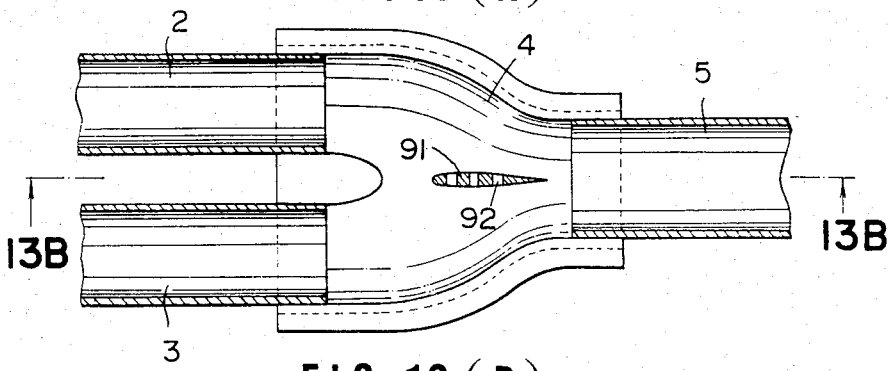
FIG. 13A is a view, similar to FIG. 4A, of a ninth embodiment of this invention.
FIG. 13B is a view, similar to FIG. 4B, of the ninth embodiment, taken along line 13B—13B of FIG. 13A.
Figure 13:
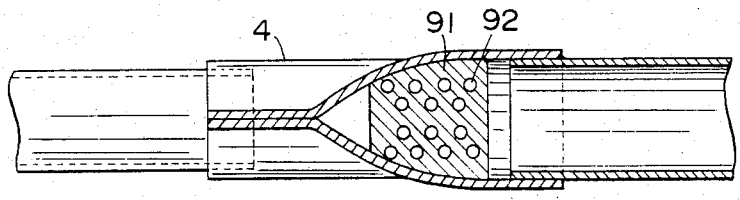

FIGS. 13A and 13B illustrate a ninth embodiment of this invention directed to improvements on the fourth embodiment. In the ninth embodiment, a partition 91 having a plurality of small holes 92 is so configured as to minimize aerodynamic resistance against the exhaust emission, stream, thereby effectively decreasing the noise of the exhaust occurring in connector 4.

Figure 14:
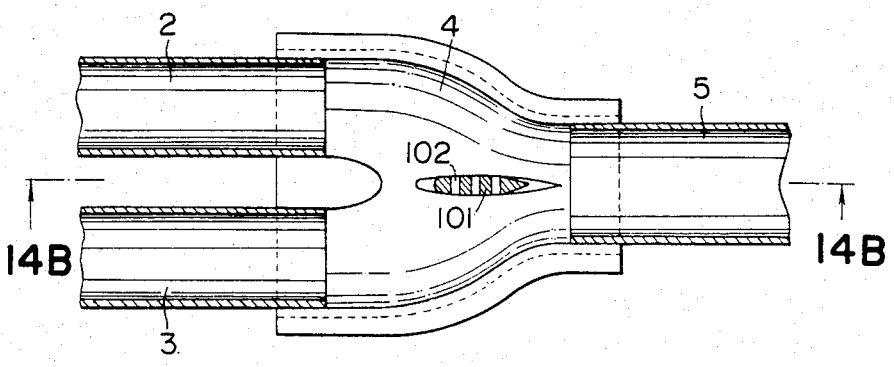
FIG. 14A is a view, similar to FIG. 4A, of a tenth embodiment of this invention.
FIG. 14B is a view, similar to FIG. 4B, of the tenth embodiment, along line 14B—14B of FIG. 14A.
Figure 14:
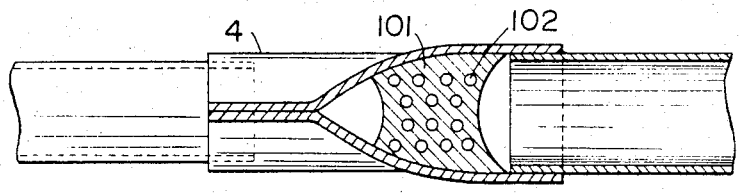

FIGS. 14A and 14B illustrate a tenth embodiment of this invention, directed to improvements on the streamline partition 101 of the embodiment of FIGS. 13A and 13B. In the tenth embodiment, the upstream and downstream ends of the partition 101 are concave. Thus, the exhaust is able to flow more smoothly through connector 4 than in the case of FIGS. 13A and 13B, so that the noise due to the flow of exhaust through connector 4 is greatly reduced.

While this invention has been shown and described in terms of several embodiments thereof, it should be noted that this invention is not limited to these embodiments, which are only for purposes of illustration. Various changes and modifications could be made by those skilled in the art without departing from the scope of this invention as set forth in the attached claims.

What is claimed is:

1. An exhaust duct connector for internal combustion engines, comprising:

(a) first means defining a substantially Y-shaped internal passage, both branches of the Y being adapted to receive a pair of upstream exhaust ducts and the leg of the Y being adapted to receive a downstream exhaust duct;

(b) a partition means coaxial with the leg of the Y and disposed at the junction of the branches of the Y, said partition means taking the form of a substantially thin plate having a plurality of small holes allowing exhaust flow therethrough.

2. An exhaust duct connector according to claim 1, wherein said partition means includes an outer partition member having a plurality of holes and an inner partition member having numerous holes significantly smaller than the holes in the outer partition member.

3. An exhaust duct connector according to claim 1, wherein said holes are slits arranged in a substantially parallel relationship.

4. An exhaust duct connector according to claim 2, wherein said partition means is positioned so as to contact said first means at the point thereof farthest upstream and exposed to both of the branches of the Y.

5. An exhaust duct connector according to claim 1, wherein the upstream end of said partition means is spaced from the opposite point of said first means so as to form a spacing allowing exhaust flow therethrough.

6. An exhaust duct connector according to claim 1, wherein said partition means comprises a sheet of a porous material.

7. An exhaust duct connector according to claim 6, wherein the upstream end of said partition means is spaced from the opposite point of said first means so as to form a spacing allowing exhaust flow therethrough.

8. An exhaust duct connector according to claim 6, wherein the upstream end of said partition means sealingly contacts said first means.

9. An exhaust duct connector according to claim 2, wherein said partition means is spaced from the opposite point of said first means so as to form a spacing allowing exhaust flow therethrough.

10. An exhaust duct connector according to claim 9, wherein said holes in said outer partition member are slits arranged in a substantially parallel relationship.

11. An exhaust duct connector according to claim 1, wherein said partition means has the cross-sectional shape of an airfoil viewed in a plane defined by the longitudinal axes of the branches of the Y.

12. An exhaust duct connector according to claim 11, wherein said partition means is spaced from the opposite point of said first means so as to form a spacing allowing exhaust flow therethrough.

13. An exhaust duct connector according to claim 12, wherein at least one of the upstream and downstream ends of said partition means is concavely curved.

* * * * *